US005524428A

United States Patent [19]

Locatelli et al.

[11] Patent Number: 5,524,428

[45] Date of Patent: Jun. 11, 1996

[54] METHOD AND APPARATUS FOR SEPARATING THE ROVING WOUND ON PACKAGES FROM THE FLYERS OF A ROVING FRAME OR THE LIKE, AND FOR SECURING THE ROVING END TO THE PACKAGES BEFORE DOFFING

[75] Inventors: Claudio Locatelli; Angelo Borgogni, both of Brescia, Italy

[73] Assignee: Fratelli Marzoli & C. S.p.A., Italy

[21] Appl. No.: 267,761

[22] Filed: Jul. 5, 1994

[51] Int. Cl.[6] ..... D01H 9/00; D01H 9/10

[52] U.S. Cl. ..... 57/276; 57/67; 57/71; 57/115; 57/117; 57/269; 57/270; 57/277; 57/278

[58] Field of Search ..... 57/267, 269, 270, 57/276, 277, 278, 67, 115, 117, 71

[56] References Cited

U.S. PATENT DOCUMENTS

| | | | |
|---|---|---|---|
| 5,117,621 | 6/1992 | Feichtinger et al. | 57/276 |
| 5,259,179 | 11/1993 | Sekiya et al. | 57/276 |
| 5,331,799 | 7/1994 | Weeger | 57/267 |

FOREIGN PATENT DOCUMENTS

| | | | |
|---|---|---|---|
| 0467475 | 7/1991 | European Pat. Off. . | |
| 3193938 | 8/1991 | European Pat. Off. | 57/267 |
| 467475 | 1/1992 | European Pat. Off. | 57/278 |
| 0504111 | 3/1992 | European Pat. Off. . | |
| 0522255 | 5/1992 | European Pat. Off. . | |
| 2665188 | 7/1990 | France . | |
| 1084619 | 6/1960 | Germany | 57/117 |
| 3023241 | 1/1982 | Germany | 57/117 |
| 918350 | 4/1982 | U.S.S.R. | 57/71 |
| 2089846 | 6/1982 | United Kingdom | 57/278 |

*Primary Examiner*—William Stryjewski
*Attorney, Agent, or Firm*—Diller, Ramik & Wight

[57] ABSTRACT

To secure the end of the roving (5) to packages (9) before their doffing from a roving frame, it is proposed to initially raise the package support carriage (2) into a position such that the lower end (4*a*) of the tubes (4) is at the level of the compressor (16) of the flyers (6), then rotate the packages (9) and flyers (6) through a few revolutions in order to wind and secure the roving (5) onto the lower end portion (4*a*) of the tubes (4), after which the carriage (2) is lowered to break the roving (5) in the section between the lower end (4*a*) of the tubes (4) and the flyers (6). Preferably, before lowering the packages (9), a reserve of roving (5) is created by slowly rotating the flyers (6) and packages (9) through a few revolutions, to simultaneously twist the roving (5) and strengthen it.

16 Claims, 3 Drawing Sheets

6
9
9a
5
5a
5b
4a
16
2
3
R
S
T
A
L

METHOD AND APPARATUS FOR SEPARATING THE ROVING WOUND ON PACKAGES FROM THE FLYERS OF A ROVING FRAME OR THE LIKE, AND FOR SECURING THE ROVING END TO THE PACKAGES BEFORE DOFFING

BACKGROUND OF THE INVENTION

This invention relates to a method and apparatus for separating the roving wound on packages from the flyers of a roving frame or the like, and for securing the roving end to the packages before doffing.

After winding the roving onto packages in a roving frame and before removing the packages from the frame, the roving is normally broken in the section between each package and the relative flyer following lowering of the package carriage, the roving end then being secured to the respective package by the operator to prevent it unwinding during the subsequent package doffing and transportation.

The halting of the roving for this purpose logically requires time, during which the frame has to remain at rest, this continuing until this operation has been carried out on all the packages, and hence for a relatively lengthy time.

The operation itself is rather uncomfortable for the operator, who has to kneel to first locate the free end of the roving and then arrange it so that it does not unwind. The need to reduce the operating time on each package as much as possible for economic reasons carries the risk that the work is not always properly carried out and that the badly secured roving end of some packages may subsequently become released and lead to the unwinding of part of the roving, so prejudicing correct package feed to the next process.

Devices are known which after the packages have been removed from the roving frame retain the roving end in contact with the winding to prevent its unwinding. These devices are however only provided along, and are only effective along, the package transport chain downstream of the roving frame and are therefore not able to prevent accidental unwinding of the roving between the frame and the commencement of the transport chain. In addition they do not eliminate the cost and unproductive time deriving from the human intervention in securing the roving to the packages on the frame. To prevent possible unwinding of the roving during that part of the package travel between the frame and the overhead conveyor, it has also been proposed to rotate the packages in the direction of winding of the roving against a stationary surface during their transport. Again, this does not totally eliminate the possibility of roving unwinding and in addition the means proposed to prevent this unwinding are rather complicated and unwieldy, so that the advantage of their use is relative.

To solve the said problems, European Patent Appln. Public. No. 0 467 475 has recently proposed a method and apparatus in which when the winding of the roving on the packages is complete, the packages at rest on the package support carriage are lowered until the upper end of the relative tubes reaches the height of the compressor of the respective flyers, after which the packages are rotated in order to wind a few turns of the roving under tension onto the upper end part of the tubes. The package support carriage is then further lowered to the doffing position, this producing breakage of the roving in that section between the upper end of the tubes and the relative flyers.

To more reliably secure the roving turns onto the upper end of the relative tubes, an annular recess or a roughened portion is provided on the upper end of the tubes in order to increase friction and hence the stability of the turns against accidental unwinding.

This method and the relative apparatus have the substantial advantage of achieving completely automatic operation on all the frame spindles in fixing the roving end before doffing, with a considerable time and cost saving.

SUMMARY OF THE INVENTION

The object of the present invention is to further improve said method and the relative apparatus such as to simplify the operations involved in locking the roving end on termination of package formation in a roving frame or the like, by ensuring effective retention of the roving end even without the use of grooves or toughened surfaces or the like on the tubes in the roving retention region and facilitating the gripping of the end for the subsequent processes.

A further object is to provide a method and relative apparatus which can also be applied to normal roving frames already in use, without problems.

These objects are attained by a method of the aforesaid type, characterised in that on termination of winding of the roving on the packages, the halted packages are raised until the lower end portion of the relative tubes reaches the height of the compressor of the respective flyers, the tubes then being rotated with the flyers so that a few turns of roving fed by the drafting unit become wound under tension about said lower end portion and remain secured thereto, the packages then being lowered relative to the flyers to cause breakage of the roving in the section between said lower end portion and the relative flyer.

Before raising the packages it can be opportune to effect a slight rotation of the packages in the opposite direction to normal running, but with the flyers and roving feed at rest, so as to create a free length of roving before securing the roving to the tube.

The method of the invention is implemented by an apparatus in a roving frame or the like comprising a raisable and lowerable package support carriage and rotary flyers together with motor means for rotating the packages and flyers and for moving the package support carriage, characterised in that said means are connected to a control unit arranged to raise the carriage with the packages at rest as far as a level in which the lower end portion of the package tubes reaches the height of the compressor of the relative flyers, to cause the packages and flyers to rotate for a few revolutions in order to wind a few turns of roving under tension about said lower end portion so securing them thereto, and to cause the packages to rotate and the carriage to descend to its doffing position, hence causing the roving to break between the respective package and flyer.

Advantageously, the apparatus can be also arranged to induce a slight rotation of the packages in the opposite direction to normal running, but with the flyers and roving feed at rest, so as to create a free length of roving before raising the carriage. Hence a method and apparatus according to the invention not only eliminates all manual action in securing the roving end to the respective packages, but results in completely automatic operation simultaneously on all spindles, with considerable time and cost saving.

Advantageously, the binding of the roving end onto the lower end portion of the tubes, ie the portion between the end engaged by the package rotator and the lower frustoconical package part, results in a retention action on the roving by the lower frustoconical part of the package during the breaking when the package is lowered from the respective flyer, hence the stability of the binding is not prejudiced. In addition the roving binding in the lower region of the package tube is better accessible to the operator, who has to grip the end of the packages hanging on the gantry of the spinning machine in order to thread it into the spinning machine, even though constructionally the gantry is higher. In addition the tubes do not need to be provided with an annular recess or special surfaces for improving the grip on the roving.

Further details and advantages of the invention will be more apparent from the description of some preferred but non-limiting embodiments thereof, illustrated by way of example on the accompanying drawings, in which:

DESCRIPTION OF THE PREFERRED EMBODIMENTS

Figure 1:
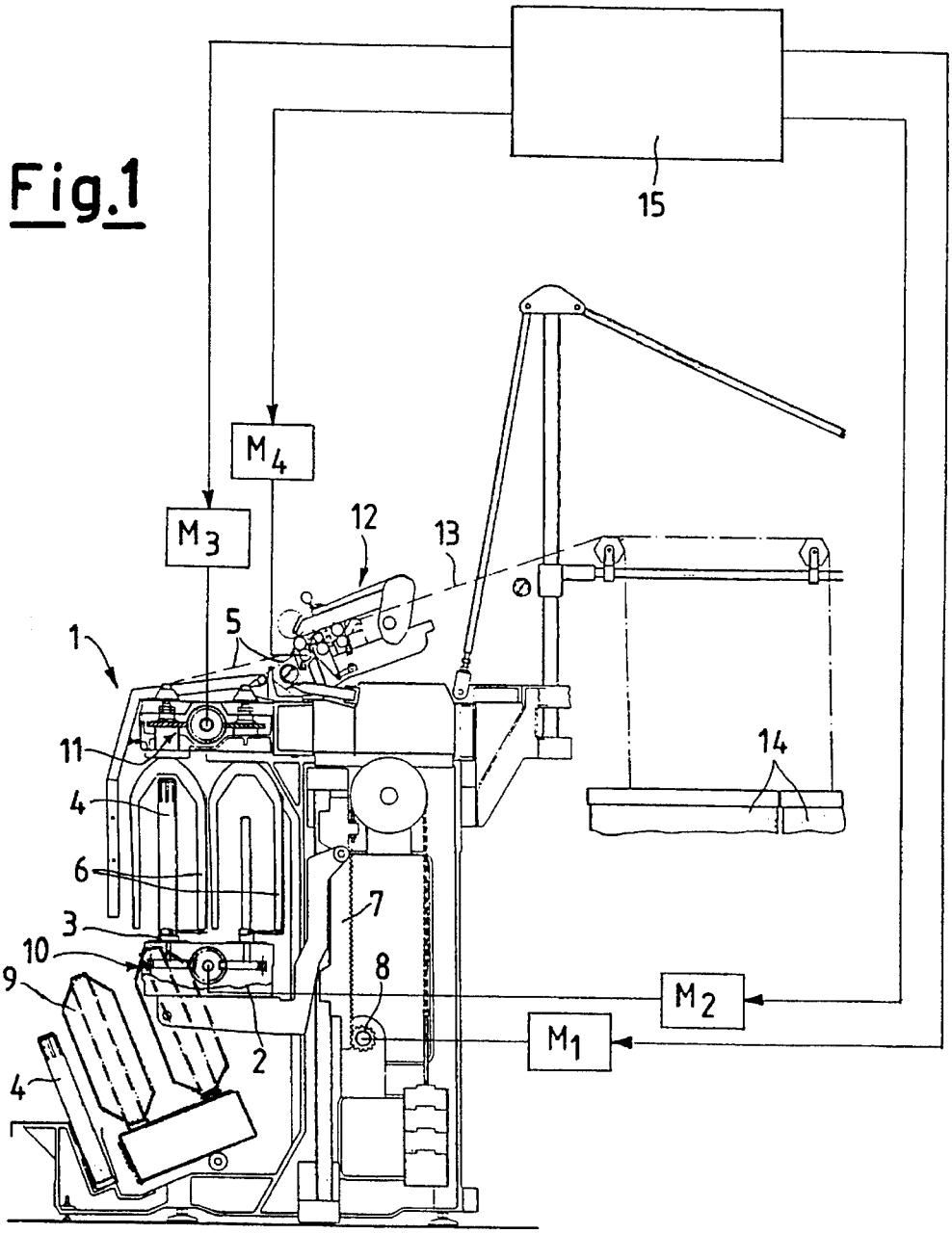
FIG. 1 is a partly sectional, partly schematic side elevation of a roving frame provided with an apparatus according to the invention.

FIG. 1 shows a roving frame of known type, indicated overall by 1 and comprising a carriage 2 carrying a plurality of package rotators 3 in a known arrangement, for rotating respective tubes on which the roving 5 provided by rotating flyers 6 is wound. The carriage 2 can be lowered and raised, there being associated with it vertically guided racks such as that indica by 7, engaging respective pinions/rotated by a motor schematically indicated by M1. The arrangement can be such that when in its lowest position the carriage 2 inclines as indicated by dashed lines, to orientate the packages 9 in their inclined doffing position, in known manner.

The package rotators 3 are rotated in known manner by a gear transmission such as that indicated by 10, driven by a motor M2. The mechanical connection between the transmission elements carried on the carriage 2 and those carried within the stationary part of the roving frame 1 is effected such as to maintain this connection in all positions of the carriage 2, using an arrangement which is known and therefore not illustrated in detail.

The flyers 6 are rotated by a transmission 11 driven by a motor indicated schematically by M3. The roving 5 reaches the flyers 6 from a drafting unit 12 of known type, which receives the sliver 13 from feed cans 14. The active rollers of the drafting unit 12 are rotated by a motor M4.

The motors M1, M2, M3 and M4 are connected to a control unit 15 arranged not only to operate these motors for the various winding operations but also to-operate them in certain sequences and manners described hereinafter, in order to automatically achieve separation and locking of the roving 5 on the respective packages 9 on termination of winding, before doffing the packages and replacing them with empty tubes 4.

Figures 2A, 2B, 2C, 2D, 2E:
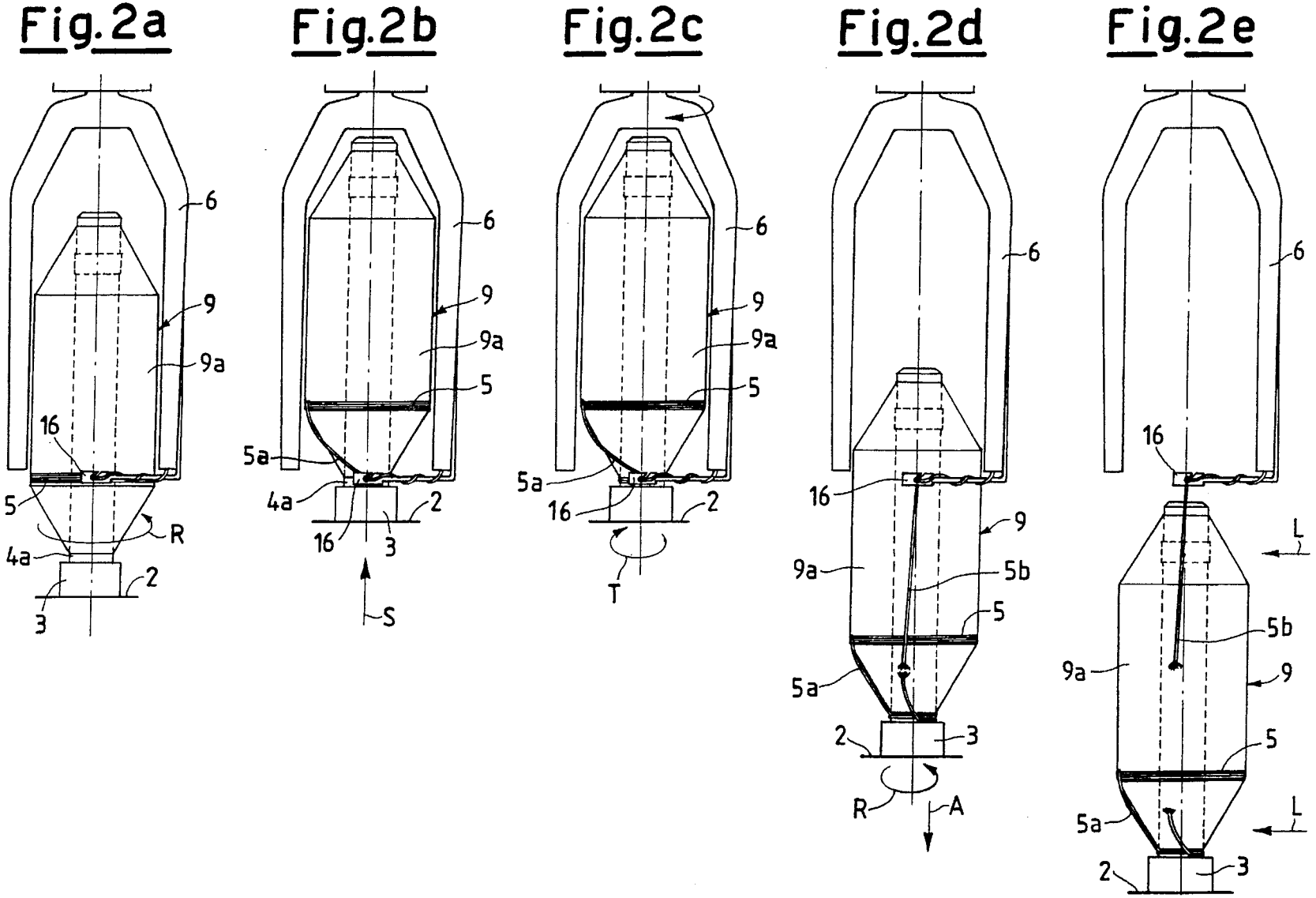
FIGS. 2*a*, 2*b*, 2*c*, 2*d* and 2*e* are side elevations showing successive steps in the method of the invention.
Figure 3D:
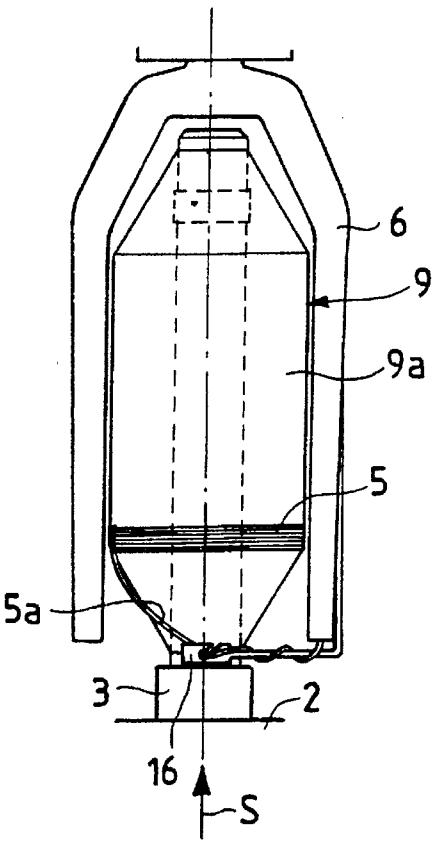
FIGS. 3*a*, 3*b*, 3*c* and 3*d* are side elevations showing certain steps in a modification of the method of FIGS. 2*a*–2*e;*
Figure 3C:
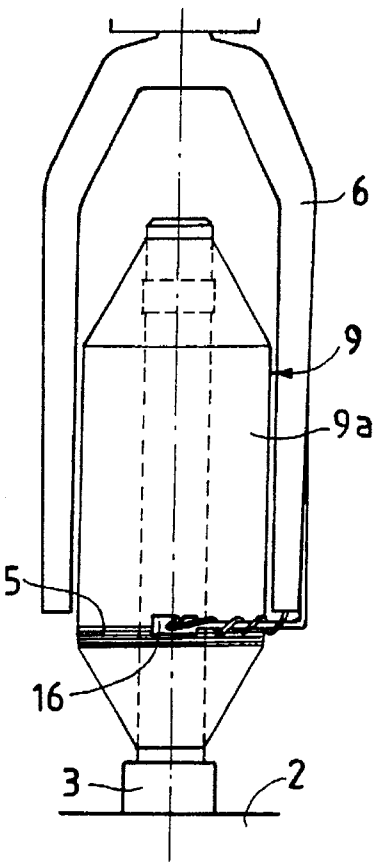
Figure 3B:
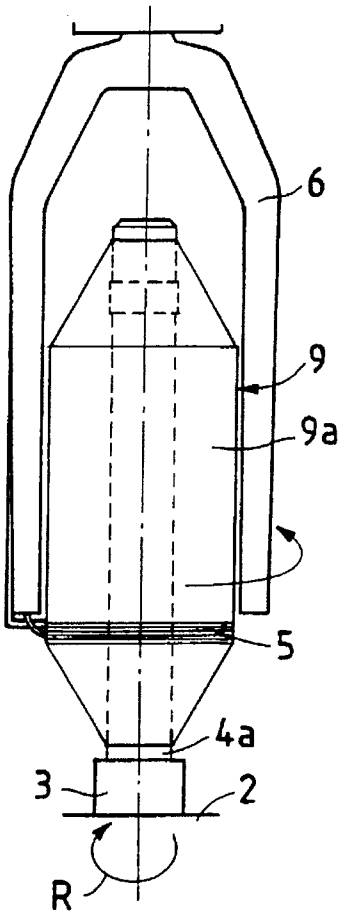
Figure 3A:
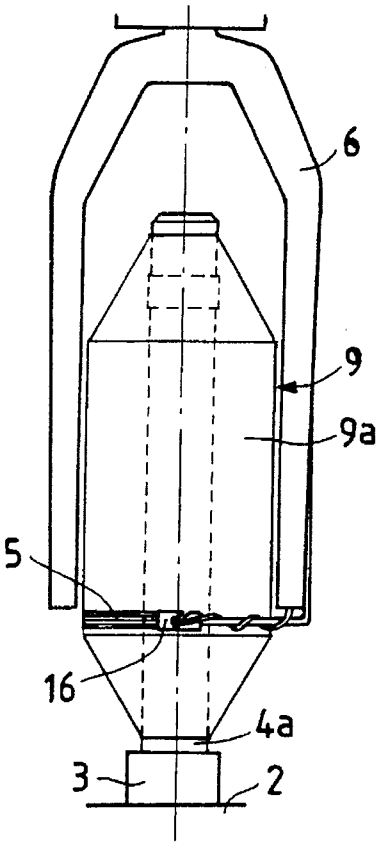

When the roving 5 has been completely wound on the packages 9, these are in the position shown in FIG. 2*a*, with the compressor 16 of the respective flyers 6 at the lower end of the cylindrical part 9*a* of the packages 9.

When in this position the packages 9 are preferably made to undergo a small rotation (for example of 60° and with the flyers and feed halted) in the reverse direction to normal running, ie in the direction of the arrow R of FIG. 2*a*, which is the opposite direction to winding and hence forming a free length of roving which enables the compressor 16 of the flyers 6 to be aligned with the lower end of the packages 9 without breakage of the roving 5 occurring.

The packages 9 are then raised (arrow S) together with the carriage 2 by a command to the motor M1, until the lower end 4*a* of the relative tubes 4 is raised to the level of the compressor 16 of the respective flyers 6 (FIG. 2*b*). In this position a length 5*a* of roving 5 is created extending from the last turn wound on the package 9 to the lower end 4*a* of the tube 4.

By means of the motors M2 and M3 the packages 9 and flyers 6 are now rotated a few revolutions in the winding direction T, in order to wind a few turns of roving 5 under tension onto the lower end 4*a* of the respective tubes 4 and hence secure it thereto (FIG. 2*c*). For this purpose the machine is controlled so as to wind the roving from the drafting unit under tension about the diameter of the tubes 4. To ensure particularly effective securing of the roving 5, the tubes 4 could be provided in this end part with an annular groove, preferably of rectangular cross-section for receiving said turns of roving 5 and effectively retaining them taut and compressed in the annular groove. Alternatively the lower end part 4*a* of the tubes 4 could be provided with a roughened or knurled or otherwise worked region for providing a more effective retaining or securing action on the wound roving 5. At this point the roving 5 is preferably reinforced by rotating the packages 9 and flyers 6 at equal speed in the normal running direction, in order to reinforce that portion of roving 5 between the flyers 6 and the drafting unit 12. This rotation is effected for a certain number of revolutions depending on the type of roving being worked. During this step the roving feed is halted.

The packages 9 and flyers 6 are then advantageously rotated backwards for example through an angle of 270°, to hence slacken and remove a few degrees of twist from the roving 5 to facilitate its subsequent breakage within its free length.

After this procedure the control unit 15 causes the package carriage 2 to descend (vertical arrow A) with simultaneous rotation of the packages 9 in the direction of the arrow R on FIG. 2*d* through an angle for example of 270°, while maintaining the flyers 6 at rest, so as to form a reserve length 5*b* of roving and at a certain point cause the roving 5 to break by tearing, within the section between the lower end 4*a* of the tubes 4 and the respective flyers 6 (FIG. 2*d*). The package carriage 2 is finally made to descend into a position such that the top of the tubes 4 is below the minimum level of the flyers 6 and there is no longer any possibility of interference between these and the tubes (FIG. 2*e*). At this point the carriage 2 is in the doffing position and can be inclined for the doffing of the packages 9. Instead of inclining the carriage 2, it could also be possible to move the carriage 2 parallel to itself in a horizontal or substantially horizontal direction, while suitably guiding the carriage (arrows L).

The packages 9, ready for doffing, now have the end of the roving 5 secured to the respective tubes 4 without any human intervention having been required for this. All the packages 9 of the roving frame have undergone the same action, with substantial time and cost savings. It should be noted that a free length of roving 5 remains, the length of which depends on the effective point of breakage of the roving 5. This free length does not however create any difficulties, and in fact facilitates location of the roving end when the package reaches the subsequent ring spinning machine.

Because of the reliable retention of the roving end, no special precautions are required at any point along the path taken by the packages between the roving frame and the ring spinning machine, with consequent simplification of transport devices compared with those currently in use. It will be apparent that with the method and apparatus of the invention no significant structural modifications are required to the traditional roving frame, it being sufficient to provide a determined sequence of commands for the drive members of the frame on termination of normal package formation, in order to automatically achieve roving stoppage and breakage. The required sequence can be easily achieved using a suitable electronic card or in any event by known methods.

As stated, before raising the packages 9 into the position shown in FIG. 2*b*, it is preferable to create a suitable reserve 5*a* of roving 5 to prevent the roving undergoing premature breakage. As illustrated in FIGS. 3*a*–3*d*, it is also possible to slowly rotate the flyers 6 and packages 9 for a few revolutions in the direction indicated in FIG. 3*b* with the feed halted, ie with the drafting unit at rest (motor M4 halted) and the packages 9 in the raised position of FIG. 3*a* (corresponding to that of FIG. 2*a*), so as to additionally twist the roving 5 (FIGS. 3*b* and 3*c*) and hence strengthen it, before reaching the position of FIG. 3*d*, which corresponds to the position of FIG. 2*b*.

Figure 4:
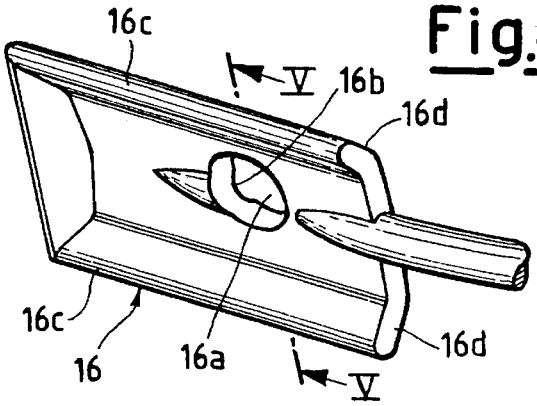
FIG. 4 is a perspective view of a flyer compressor particularly advantageous for implementing the method of the invention.
Figure 5:
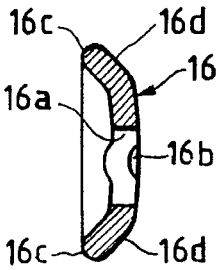
FIG. 5 is a section on the line V—V of FIG. 4.

Advantageously the compressor 16 of the flyers 6 can have a configuration as shown in FIGS. 4 and 5. It is provided with a hole 16*a* for passage of the roving 5, which towards the package 9 is guided in a recess 16*b* formed in the plate of the compressor 16 at the hole 16*a* and having a depth which progressively decreases in the direction of movement of the roving 5. The plate of the compressor 16 is bent outwards along the (horizontal) longitudinal edges 16*c* of the compressor 16, to thus create two inclined surfaces 16*d* converging towards the packages 9 at the opposing edges of the substantially plate-like central part of the compressor 16. These inclined surfaces 16*d* facilitate the relative movement between the packages and flyers in the axial direction of the packages 9 at the package conic portions.

Specifically, during the descent of the packages 9 in passing from the position of FIG. 2*c* to the position of FIG. 2*d*, the aforedescribed configuration facilitates the radial withdrawal of the compressor 16 from the lower end 4*a* of the tubes in contact with the lower conic portion of the packages 9, without hindering the relative movement and without damaging the wound roving. The wound part of the packages can hence be correctly unwound in the downstream spinning machine without irregularity.

Various modifications can be made in addition to those described without leaving the scope of the present invention. The roving frame could obviously be of automatic doffing type without this implying any modification in the method and apparatus of the invention.

Although a preferred embodiment of the invention has been specifically illustrated and described herein, it is to be understood that minor variations may be made in the apparatus without departing from the spirit and scope of the invention, as defined the appended claims.

We claim:

1. A method of breaking roving wound on a tube of a package from a flyer of a roving frame and for securing a roving end to the package before doffing the package from the roving frame comprising the steps of:

(a) winding roving upon a tube to form a package, (b) terminating the winding of the roving, (c) raising the package until a lower end of the tube is substantially adjacent a compressor of the flyer, (d) thereafter rotating the tube and flyer to wind a few turns of the roving upon the tube lower end, and (e) thereafter lowering the package relative to the flyer to break the roving in a section between the tube lower end and the compressor.

2. The method as defined in claim 1 wherein the winding of step (a) is performed by rotating the package in a first direction, and prior to raising the package pursuant to step (c) rotating the package slightly in a second direction opposite the first direction with the flyer at rest to create a free length of roving and thereafter performing step (d).

3. The method as defined in claim 1 wherein after performing step (d) rotating the package and flyer at the same speed in a normal running direction while maintaining roving feed at rest to provide the roving with additional twist and reinforcement.

4. The method as defined in claim 3 wherein prior to performing step (e) the package and flyer are rotated opposite to the package winding direction to slacken the roving and remove a few turns of twist from the roving.

5. The method as defined in claim 1 wherein during the performance of step (e) rotating the package in a direction opposite to the winding direction of step (a) while maintaining the flyer at rest to form a reserve length of roving between the tube lower end and the compressor before the performance of step (e).

6. The method as defined in claim 1 wherein the tube has an annular recess at the tube lower end, and step (d) is performed by winding the few roving tugs in the annular recess.

7. The method as defined in claim 1 wherein the tube has a roughened surface at the tube lower end, and step (d) is performed by winding the few roving turns on the roughened surface.

8. The method as defined in claim 1 wherein step (e) is performed by lowering the package substantially vertically to break the roving.

9. A method of breaking roving wound on a tube of a package from a flyer of a roving frame and securing a roving end to the package before doffing the package from the roving frame comprising the steps of:

(a) winding roving upon a tube in a first direction to form a package with the tube, the package, and the flyer rotating in the first direction, (b) at the conclusion of step (a) rotating the package in a second direction opposite to the first direction through a predetermined angle with the flyer and roving feed halted, (c) raising the package until a lower end of the tube reaches the height of a compressor of the flyer, (d) again rotating the package and flyer to wind a few turns of fed roving under tension upon the lower end of the tube, (e) rotating the package and flyer at the same speed in the first direction for a few revolutions with roving feed halted to reinforce the roving by twisting, (f) thereafter rotating the flyer and package in the second direction through a predetermined angle to slacken the twist in the roving, (g) lowering the package, (h) rotating the lowered package in the second direction to further slacken the twist in the roving, and (i) further lowering the package relative to the flyer to break the roving in a roving section between the tube lower end and the flyer.

10. An apparatus for breaking roving (5) wound on a tube of a package (9) comprising a carriage (2) for supporting the tube (4) relative to a flyer (6) and a compressor (16), means (M1, 7, 8) for raising and lowering the carriage (2), means (M2) for rotating a package rotator (3) supporting the tube (4), means (M3) for rotating the flyer, and control means (15) for controlling the operation (a) of the raising and lowering means (M1, 7, 8) to raise the carriage (2) to a position at which a lower end (4*a*) of the tube (4) reaches the height of the compressor (16) of the flyer (6), (b) of the package rotating means (M2) and the flyer rotating means (M3) to rotate for a few revolutions to wind a few turns of the roving (5) under tension about the tube lower end (4), and (c) of the raising and lowering means (M1, 7, 8) to lower the carriage (2) and the package (9) to its doffing position thereby causing the roving (5) to break at a point between the package (9) and the package lower end (4*a*).

11. The apparatus as defined in claim 10 wherein said control means (15) controls the operation of said package rotating means (M3) to operate said package rotating means (M3) to rotate the package (9) during the lowering of the carriage (2).

12. The apparatus as defined in claim 10 wherein said control means (15) is operative to selectively operate said package rotating means (M2) to rotate the package (9) a small rotation in a direction opposite to the winding direction with the flyer (6) and an associated roving feed means (12) halted to thereby create a free length (5*b*) of roving before the raising of the carriage (2).

13. The apparatus as defined in claim 10 wherein said control means (15) is operative to selectively operate said package rotating means (M2) and said flyer rotating means (M3) to rotate the package (9) and the flyer (6) at the same speed during winding direction running while an associated roving feed means (12) is halted to impart additional twist and reinforcement to the roving (5) before the lowering of the carriage.

14. The apparatus as defined in claim 10 wherein said control means (15) is operative to selectively operate said package rotating means (M2) and said flyer rotating means (M3) to rotate the package (9) and the flyer (6) in a direction opposite to the winding direction to slacken the twist in the roving (5) before the lowering of the carriage.

15. The apparatus as defined in claim 10 wherein said control means (15) is operative to continue the lowering of the carriage (2) after the roving (5) has broke.

16. The apparatus as defined in claim 10 wherein the compressor (16) includes a central apertured plate-like portion and opposite longitudinal edge portions diverging away from said central portion.

* * * * *